United States Patent [19]

Martino

[11] 4,060,973

[45] Dec. 6, 1977

[54] AUTOMATIC VARIABLE-SOUND ALARM CLOCK

[76] Inventor: Dom Martino, 1 Emmalon Circle, White Plains, N.Y. 10602

[21] Appl. No.: 673,092

[22] Filed: Apr. 2, 1976

[51] Int. Cl.[2] ..... G04C 21/16

[52] U.S. Cl. ..... 58/19 R; 58/16.5; 58/16 D

[58] Field of Search ..... 58/150, 19 R, 14, 12, 58/38 R, 38 A, 57.5, 16 D, 21.12, 13, 8, 16.5; 340/309.1, 384 E, 392; 325/396

[56] References Cited

U.S. PATENT DOCUMENTS

| | | | |
|---|---|---|---|
| 1,858,563 | 5/1932 | Schlenker | 58/21.12 |
| 3,420,051 | 1/1969 | Matteson | 58/14 |
| 3,593,148 | 7/1971 | Cummings | 325/396 |
| 3,611,151 | 10/1971 | Fernandez | 325/396 |
| 3,835,640 | 9/1974 | Hughes | 58/14 |
| 3,873,921 | 3/1975 | Petrinec | 325/396 |
| 3,900,798 | 8/1975 | Pomerantz et al. | 325/396 |
| 3,949,303 | 4/1976 | Nishimura | 325/396 |

*Primary Examiner*—Ulysses Weldon
*Attorney, Agent, or Firm*—Gottlieb, Rackman & Reisman

[57] ABSTRACT

There is disclosed an alarm clock in which the alarm sound is changed automatically at periodic intervals. In the illustrative embodiment of the invention, the clock emits eight different alarm sounds, and the alarm sound is changed automatically every 24 hours. By so changing the alarm sound, a sleeper cannot become accustomed to one particular alarm signal, thereby becoming "immune" to it.

7 Claims, 1 Drawing Figure

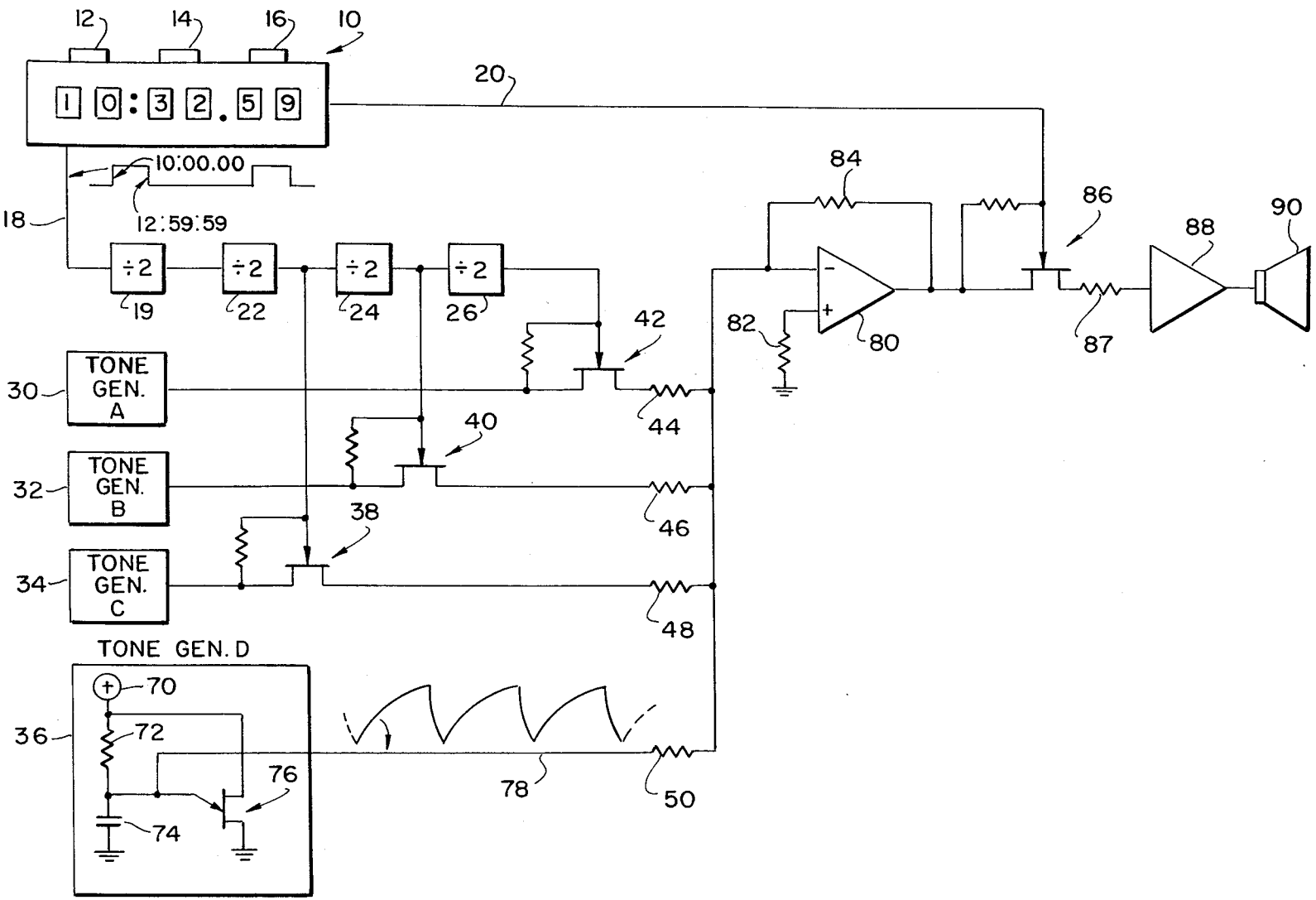
TONE GEN. A
TONE GEN. B
TONE GEN. C
TONE GEN. D
÷2
10:00.00
12:59:59

AUTOMATIC VARIABLE-SOUND ALARM CLOCK

This invention relates to alarm clocks, and more particularly to alarm clocks in which the alarm sound is changed automatically at periodic intervals.

The conventional alarm clock generates the same sound whenever the alarm is to be sounded. It has been found that many people, especially heavy sleepers, become so accustomed to the same sound being generated each morning that they become "immune" to it and do not wake up. It is a general object of my invention to prevent people from becoming accustomed to the sound generated by an alarm clock.

Briefly, in accordance with the principles of my invention, the sound of the alarm is changed at periodic intervals. In the preferred embodiment of the invention, there are eight possible alarm sounds, and they are switched at 24 hour intervals. Although as few as two different sounds, changed at perhaps only two-day or three-day intervals, do reduce the possibility of a person becoming so accustomed to the alarm that he ignores it, with eight different-sounding alarms, changed at daily intervals, there is almost no possibility of a person becoming immune to all, or even any, of them. An added advantage of using eight different-sounding alarms is that the sound/day-of-week cycle repeats itself at 56 day intervals. Even those people who use an alarm clock on only one day of each week hear a different alarm sound on that particular day during 8 successive weeks.

It should be noted that some prior art alarm clocks provide at least two different-sounding alarms. The particular sound emitted by the clock is selectable by the user and, after having been initially selected, is heard to the exclusion of the others. The object of providing different-sounding alarms in the prior art is to enable the user to select the sound which is most pleasing to him. The object of the present invention is the converse; the object is to prevent the user from selecting the sound which is most "pleasing" to him, e.g., a sound which can be ignored.

Briefly, the illustrative embodiment of the invention is disclosed in the context of a digital alarm clock, in which digital signal control the display (for example, a display consisting of light emitting diode elements). The alarm itself consits of a combination of tones from several tone generators, the combination changing every 24 hours. It has been found most convenient to use the signal which controls the decade digit to also control the automatic changing of the alarm sound. Although the electronic implementation of the present invention is preferred, it is to be understood that mechanical arrangements are similarly within the embrace of the invention.

Further objects, features and advantages of my invention will become apparent upon consideration of the following detailed description in conjunction with the drawing which depicts an illustrative embodiment of the invention.

In the drawing, clock 10 is shown only symbolically. It includes a conventional digital display in the form of hours, minutes and seconds. As shown in the drawing, the time displayed by clock 10 is 10:32.59. The clock includes these controls, 12, 14 and 16, sbown only symbolically in the drawing. Control 12 allows the setting of the time on the display, control 14 allows the user to select the time when the alarm is to be sounded, and control 16 is the mechanism for arming the alarm so that it can be sounded at the selected time and for turning off the alarm after waking up.

Two conductors 18 and 20 are shown extending from clock 10. Conductor 20 is normally at ground potential, but goes high if the alarm is to be sounded. Provided control 16 is set so as to enable the alarm, the potential on conductor 20 goes high when the time of day displayed on the clock reaches the time of day set by the user for the alarm to be sounded. The potential on conductor 20 then remains high until control 16 is operated so as to shut off the alarm.

Conductor 18 is connected to the control input for the decade display of the clock. Whenever a 1 is displayed, the potential on conductor 18 is high; at all other times, the potential is low. As indicated by the waveform adjacent to conductor 18 in the drawing, the conductor is high in potential between 10:00.00 and 12:59.59. Although the conductor is high in potential for only three hours during each 12-hour period, this is of no concern; it is only positive transitions in the potential on conductor 18 which affect the changing of the alarm sound, and such a positive transition occurs every 12 hours.

Four divide-by-two circuits 19, 22, 24 and 26 are provided in series. Each of these divide-by-two circuits is a flip-flop whose state changes whenever there is a positive transition at the respective input. Whenever a flip-flop is in the 1 state its output is high, and whenever a flip-flop is in the O state its output is low. The outputs of flip-flops 22, 24 and 26 are extended to the control inputs of respective analog switches 38, 40 and 42 (each analog switch consists of a field-effect transistor with a resistor connected between the source and gate). Each of the switches is held on whenever its controlling flip-flop is in the 1 state. Flip-flop 19 does not control a respective analog switch. Instead, it functions to provide a positive transition at the input of flip-flop 22 at 24-hour intervals. Thus switch 38 turns on and off at 24-hour intervals. Since it is only positive transitions at the output of flip-flop 22 which control a change in the state of flip-flop 24, it is apparent that analog switch 40 turns on and off at 2-day intervals. In a similar manner, analog switch 42 turns on and off at 4-day intervals. It is thus apparent that there are eight combinations of switch conditions and that it takes eight days for the switch combinations to repeat themselves. If the state of each switch is represented by a 1 or a 0, it is apparent that the combined states cycle from 000 through 111 every 8 days.

A respective tone generator 30, 32 and 34 is connected to the input of each analog switch. Each tone generator generates a different tone represented by one of the respective letters A, B and C. The outputs of the three analog switches are extended through respective summing resistors 44, 46 and 48 to a summing junction at the minus input of operational amplifier 80. The plus input of the operational amplifier is connected through a resistor 82 to ground, and a feed-back resistor 84 is connected between the output and the minus input. The operational amplifier thus functions as a summer. A fourth tone generator 36, emitting a tone D, is connected through tone another summing resistor 50 to the summing junction. An illustrative circuit for tone generator 36 is depicted in the drawing. This circuit is a conventional one and consists of a resistor 72 and a capacitor 74 connected in series between a positive supply 70 and ground. A unijunction transistor 76 is connected as shown. As capacitor 74 charges, the potential across it increases until the unijunction transistor 76 conducts. At this time, the capacitor rapidly discharges through the transistor, following which the transistor turns off and the capacitor starts to charge once again. The resulting waveform on conductor 78 is as shown in the drawing. The frequency of the waveform depends upon the magnitudes of resistor 72 and capacitor 74. The other three tone generators are of the same design, except that by using different values for their respective resistors and/or capacitors, their frequencies are all different. (Sine-wave, square-wave, etc. tone generators may also be used, and with different mixes of them.)

The net result of the arrangement is that the output of operational amplifier 80 is a signal having at least one tone component, and a maximum of four. Tone D is always represented at the output of operational amplifier because there is no analog switch conneced between the output of tone generator 36 and the summing junction. Of the other three tones, none, one, two or all three may be present in the output of operational amplifier 80, depending upon which of the three analog switches are turned on at any given instant. It is thus apparent that there are eight different-sounding signals at the output of operational amplifier 80 and that the signal changes at 24-hour intervals, with the cycle repeating itself every eight days.

The output of operational amplifier 80 is extended through analog switch 86 which is turned on only when the potential on conductor 20 is high. Thus whenever the alarm is to be sounded, the signal at the output of operational amplifier 80 is extended through analog switch 86 and resistor 87 to the input of driver 88. The driver simply serves to amplify the signal and to provide the proper source impedance for speaker 90.

It should be noted that the interface to the alarm-generating system in the illustrative embodiment of the invention is particularly advantageous. Only two signals must be extracted from the conventional digital clock circuitry. One of these is the signal for controlling the decade display and is necessarily available in any digital clock. The other is the conventional alarm triggering signal (on conductor 20). It is to be understood, of course, that the alarm-generating system shown in detail in the drawing is preferably included in the same housing which encloses the clock itself.

Although the invention has been described with reference to a particular embodiment, it is to be understood that this embodiment is merely illustrative of the application of the principles of the invention. For example, a conventional alarm clock can also be used for automatically controlling the changing of the alarm sound. A cam on the hour shaft, for example, could control the closing of a pair of contacts once every 12 hours, with the closing of these contacts serving to switch the state of flip-flop 19. Also, instead of the alarm sounds being tones, they may be verbal announcements, each announcement being a recording by a different person or conveying a different message. For example, eight different recordings might be provided. In such a case, the outputs of flip-flops 22, 24 and 26 might serve as inputs to a 1-out-of-8 decoder, the single energized output of the decoder enebling a respective announcement playback circuit and the energized decoder output changing daily. With verbal alarm sounds, if only seven different messages are provided, the sleeper may actually be informed of the day of the week as part of the message. Thus it is to be understood that numerous changes may be made in the illustrative embodiment of the invention and other arrangements may be devised without departing from the spirit and scope of the invention.

What I claim is:

1. An alarm clock comprising display means for displaying the time of day, means for representing a time of day when an alarm is to be sounded, means for generating an alarm sound when the time of day displayed on said display means corresponds to the time of day represented by said representing means, said alarm sound generating means including means for generating at least two predetermined alarm sounds having different tone contents, and means for automatically changing the alarm sound which is generated by said alarm sound generating means at periodic intervals to control the generation of different predetermined alarm sounds when an alarm is first sounded on different days.

2. An alarm clock in accordance with claim 1 whereon said alarm sound is changed automatically at least as frequently as at 1-day intervals.

3. An alarm clock in accordance with claim 1 wherein said alarm sound generating means generates eight different alarm sounds.

4. An alarm clock in accordance with claim 1 wherein said alarm sound generating means generates eight different alarm sounds, with a different alarm sound being generated during each 24-hour period in an 8-day cycle.

5. An alarm clock in accordance with claim 4 wherein said display means is a digital display having a decade position whose state is controlled by a respective control signal, and said alarm sound generating means includes a plurality of tone generators, the respective tones of which are selectively added together in different combinations, and means for changing the combination in which said tones are added responsive to changes in said decade position control signal.

6. An alarm clock in accordance with claim 1 wherein said display means is a digital display having a decade position whose state is controlled by a respective control signal, and said alarm sound generating means includes a plurality of tone generators, the respective tones of which are selectively added together in different combinations, and means for changing the combination in which said tones are added responsive to changes in said decade position control signal.

7. An alarm clock in accordance with claim 1 wherein said alarm sound is changed automatically at one-day intervals and said alarm sound generating means generates at least seven different alarm sounds.

* * * * *